US007668489B2

(12) United States Patent
Kim et al.

(10) Patent No.: US 7,668,489 B2
(45) Date of Patent: Feb. 23, 2010

(54) TONER PATH OPENING AND CLOSING APPARATUS, IMAGE FORMING DEVICE HAVING THE SAME AND TONER PATH OPENING AND CLOSING METHOD THEREOF

(75) Inventors: Dae-ho Kim, Uiwang-si (KR); Kurgi Eduard, Suwon-si (KR); Jin-geun Kwak, Suwon-si (KR); Sung-wook Kang, Seoul (KR); Ji-hoon Woo, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 133 days.

(21) Appl. No.: 11/873,729

(22) Filed: Oct. 17, 2007

(65) Prior Publication Data

US 2008/0181673 A1 Jul. 31, 2008

(30) Foreign Application Priority Data

Jan. 29, 2007 (KR) ..... 10-2007-0009137

(51) Int. Cl.
*G03G 15/08* (2006.01)

(52) U.S. Cl. ..... 399/258; 399/119; 399/260; 399/120; 399/106; 399/262

(58) Field of Classification Search ..... 399/258, 399/260, 262, 119, 120, 106
See application file for complete search history.

(56) References Cited

U.S. PATENT DOCUMENTS

2007/0237551 A1* 10/2007 Kawai ..... 399/258

* cited by examiner

*Primary Examiner*—David M Gray
*Assistant Examiner*—G. M. Hyder
(74) *Attorney, Agent, or Firm*—Staas & Halsey LLP

(57) ABSTRACT

A toner path opening and closing apparatus of an image forming device includes a first shutter elastically supported by a first elastic member to open and close a first toner path, and a second shutter elastically supported by a second elastic member having an elastic modulus smaller than the first elastic member to open and close a second toner path by the first shutter. After the second toner path is opened by the first shutter, the first is opened, so that the first and second toner paths communicate with each other. The first toner path is a toner supplying pipeline to which a toner is supplied from a toner cartridge, and the second toner path is a toner injecting port disposed in a developing unit. In mounting of the developing unit, after the toner injecting port disposed in the developing unit is first opened, the toner supplying pipeline is opened, and in dismounting of the developing unit, after the toner supplying pipeline is first closed, the toner injecting port is closed, so that in mounting and dismounting of the developing unit, toner is prevented from being leaked through the toner paths.

20 Claims, 12 Drawing Sheets

TONER PATH OPENING AND CLOSING APPARATUS, IMAGE FORMING DEVICE HAVING THE SAME AND TONER PATH OPENING AND CLOSING METHOD THEREOF

CROSS-REFERENCE TO RELATED APPLICATIONS

This application claims the benefit of Korean Application No. 2007-9137, filed Jan. 29, 2007 in the Korean Intellectual Property Office, the disclosure of which is incorporated herein by reference.

BACKGROUND OF THE INVENTION

1. Field of the Invention

Aspects of the present invention relate to an image forming apparatus. More particularly, aspects of the present invention relate to a toner path opening and closing apparatus having an improved structure to regulate the inflow and outflow of toner that is supplied to a developing unit from a toner cartridge, an image forming apparatus having the same and a toner path opening and closing method thereof.

2. Description of the Related Art

In general, a small image forming apparatus, such as a printer, has a developing unit in which a photoconductive medium and a toner containing part are integrally formed. However, a large image forming apparatus, such as a copier or a large printer, is configured with a developing unit having a photoconductive medium, such as an OPC drum, disposed therein and a toner cartridge containing a toner formed apart from the developing unit. In these large image forming apparatuses, the developing unit is often designed to be detached from the image forming apparatus, and another one put in its place.

FIGS. 1 and 2 are schematic prior art views of parts of a large image forming device exemplifying a developing unit detachably disposed from a main body and a toner supplying pipeline provided on part of the main body. A toner supplying pipeline 2 to which a toner cartridge (not illustrated) is connected is disposed in the main body 1 of the image forming device. The toner supplying pipeline 2 is opened and closed by a first shutter 3. A first sponge 4 is interposed between the toner supplying pipeline 2 and the first shutter 3. The first shutter 3 is elastically supported by a first elastic member 5, so that if an external force is not applied, it can close down the toner supplying pipeline 2.

A toner injecting port 11 is disposed in a developing unit 10, and the developing unit 10 is connected to the toner supplying pipeline 2. The toner injecting port 11 is opened and closed by a second shutter 12. A second sponge 14 is interposed between the toner injecting port 11 and the second shutter 12. The second shutter 12 is elastically supported by a second elastic member 15, so that if an external force is not applied, it can close down the toner injecting port 11.

FIGS. 3A through 3F are schematic views exemplifying prior art designs by which the toner supplying pipeline 2 and the toner injecting port 11 are connected to each other as the developing unit is mounted in the main body 1. In FIGS. 3A and 3B, when the developing unit 10 is mounted in the main body 1, an end tip of the developing unit 10 pushes a first shutter protrusion 3*a* projecting from the first shutter 3 to push and open the first shutter 3 in the direction of arrow A illustrated in FIG. 3A, and another end of the developing unit mount provided in the main body 1 pushes a second shutter protrusion 12*a* projecting from the second shutter 12 to push and open the second shutter 12 in the direction of arrow B illustrated in FIG. 3A.

Then, as illustrated in FIGS. 3C and 3D, a portion of the first sponge 4 where the first shutter 3 is opened and a portion of the second sponge 14 where the second shutter 12 is opened are pushed together and engage with each other to form a toner path. When the toner supplying pipeline 2 and the toner injecting port 11 are simultaneously opened and therefore communicate with each other by way of the toner path, toner in the toner supplying pipeline 2 begins to flow through the toner injecting port 11.

When the toner supplying pipeline 2 and the toner injecting port 11 are opened as described above and the first and the second shutter 3 and 12 are in a fully open state, the toner supplying pipeline 2 and the toner injecting port 11 are completely connected with each other, as illustrated in FIGS. 3E and 3F. However, when the toner supplying pipeline 2 and the toner injecting port 11 simultaneously start opening as described above, there is a period of time where the toner supplying pipeline 2 and the toner injecting port 11 do not coincide with each other while the first and the second shutter 3 and 12 are opened. That is, when the toner supplying pipeline 2 and the toner injecting port 11 start opening, toner that is injected through the portion of the toner supplying pipeline 2 hatched in FIG. 4A is not supplied to the developing unit 10 through the open portion of the toner injecting port 11 hatched in FIG. 4B. As a result, the portion or section of the toner pipeline 2 that is shaded in FIG. 4C is contaminated.

If the developing unit is repeatedly mounted and dismounted, toner accumulates in this section of the toner pipeline 2, and the toner in the contaminated section is spreads in the toner injecting port as a result of opening and closing of the second shutter 12. As the amount of toner that accumulates in the contaminated section increases as described above, the accumulated toner scatters and contaminates the inside of the image forming device, thereby resulting in image contamination and malfunction of the image forming device.

SUMMARY OF THE INVENTION

Aspects of the present invention have been developed in order to solve the above and/or other problems in the related art. Accordingly, aspects of the present invention provide a toner path opening and closing apparatus having an improved structure to prevent toner contamination to a developing unit during mounting and dismounting of the developing unit, an image forming apparatus having the same, and a toner path opening and closing method thereof.

One aspect of an exemplary embodiment of the present invention provides a toner path opening and closing apparatus of an image forming device, including a first shutter elastically supported by a first elastic member to open and close a first toner path, and a second shutter elastically supported by a second elastic member having an elastic modulus smaller than the first elastic member to open and close a second toner path by the first shutter. After the second toner path is opened by the first shutter, the first toner path is opened, so that the first and the second toner paths communicate simultaneously with each other.

Preferably, but not necessarily, the first shutter has a hole through the first shutter formed to communicate with the second toner path, and a protrusion formed to come in contact with a member in which the second toner path is formed. Preferably, but not necessarily, a first sealing member is interposed between the first toner path and the first shutter, and a second sealing member is interposed between the second toner path and the second shutter. The first and the second sealing members may be formed of a sponge, urethane foam or silicone rubber. The first toner path may be a toner supplying pipeline disposed in the main body of an image forming device to receive toner from a toner cartridge, and the second toner path may be a toner injecting port disposed in a developing unit detachably joined to the main body.

In this embodiment, there also may be a rotating lever that has one end connected to the second elastic member and one end connected to the second shutter, to rotate in combination with a sliding movement of the second shutter. Preferably, but not necessarily, the rotating lever includes a moving part to receive a rotary force by an interference member in open operation of the second shutter, and first and second protrusions projecting to selectively restrain the position of the second shutter.

Another aspect of an exemplary embodiment of the present invention provides an image forming device, including a toner cartridge detachably disposed to a main body of the image forming device and connected to a first toner path for supplying a toner, a developing unit in which a second toner path is formed to connect with the first toner path, and a toner path opening and closing apparatus as described above.

Another aspect of an exemplary embodiment of the present invention provides a toner path opening and closing method for an image forming device, including: i). opening the second toner path by pushing out a second shutter for opening and closing the second toner path by a first shutter for opening and closing a first toner path, and ii). opening the first toner path by the first shutter to communicate the first and the second toner path with each other after the second toner path is completely opened. Preferably, but not necessarily, the opening includes opening the second toner path through a hole through the first shutter.

Additional aspects and/or advantages of the invention will be set forth in part in the description which follows and, in part, will be obvious from the description, or may be learned by practice of the invention.

DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
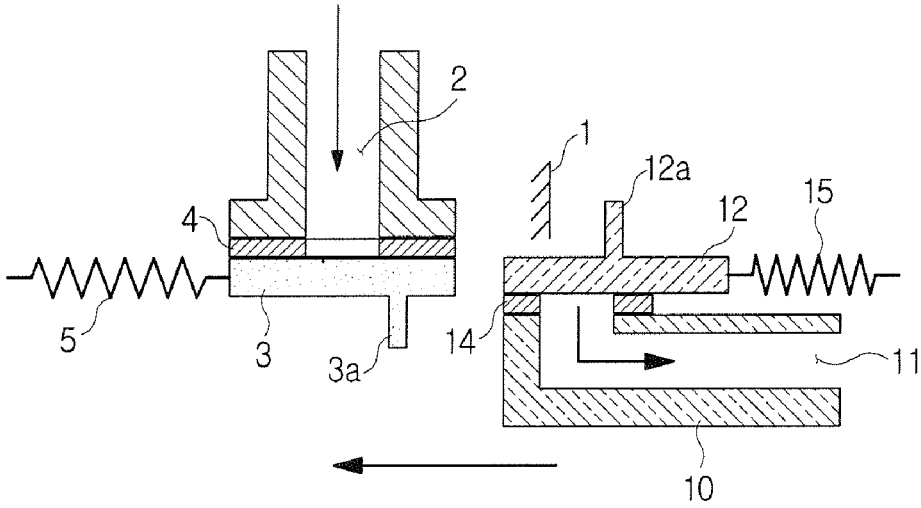
FIG. 1 (PRIOR ART)
FIG. 1 is a schematic view exemplifying a toner path opening and closing apparatus of a general image forming device according to the prior art.
Figure 2:
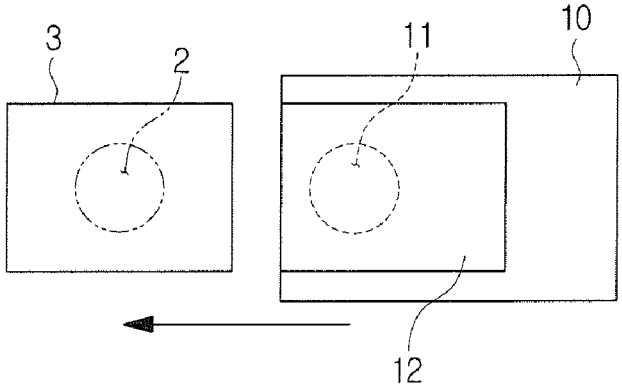
FIG. 2 (PRIOR ART)
FIG. 2 is a top plan view exemplifying first and second shutters of the toner path opening and closing apparatus of FIG. 1.
Figure 3A:
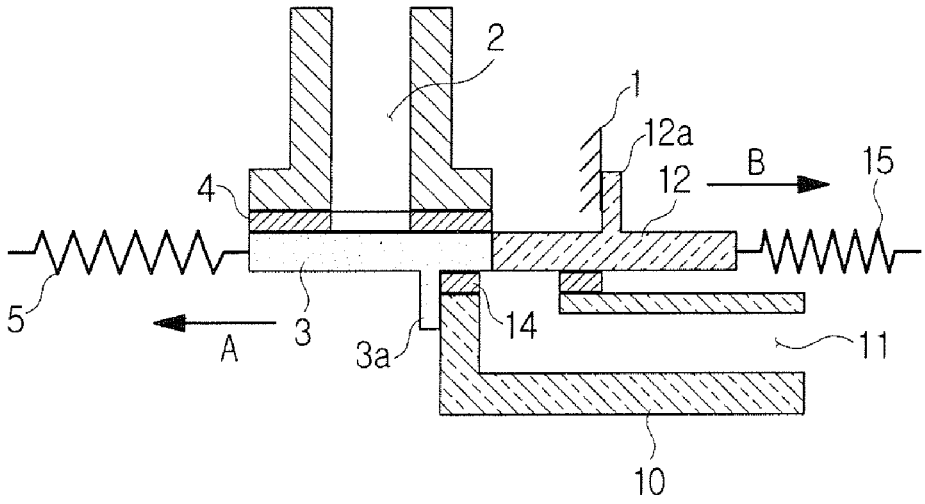
FIG. 3A (PRIOR ART)
FIGS. 3A through 3F are schematic views exemplifying operation of opening and closing a toner supplying pipeline and a toner injecting port of the general toner path opening and closing apparatus of FIG. 1.
Figure 3B:
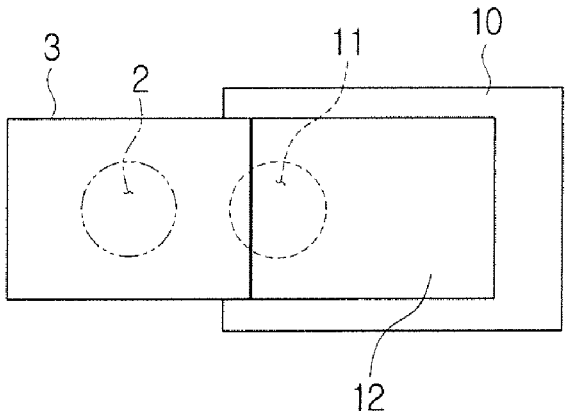
FIG. 3B (PRIOR ART)
Figure 3C:
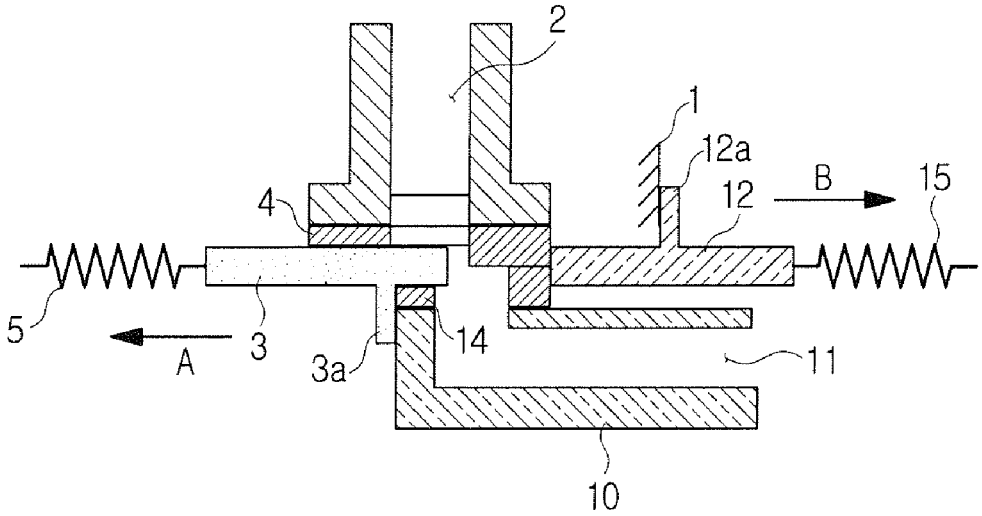
FIG. 3C (PRIOR ART)
Figure 3D:
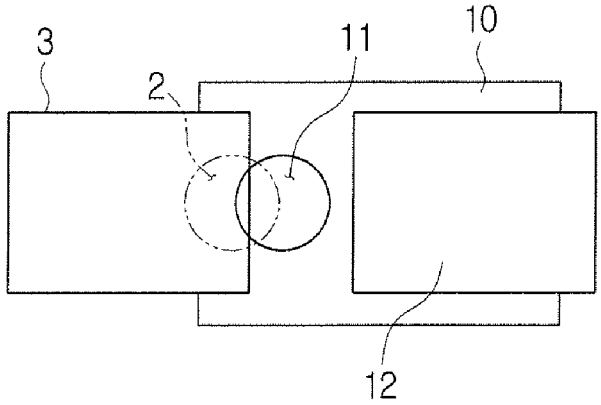
FIG. 3D (PRIOR ART)
Figure 3E:
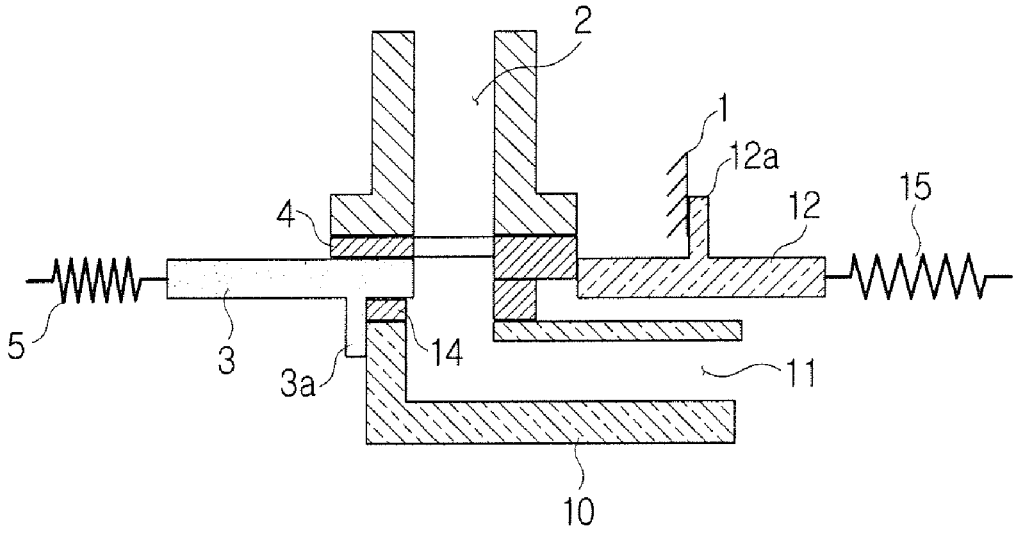
FIG. 3E (PRIOR ART)
Figure 3F:
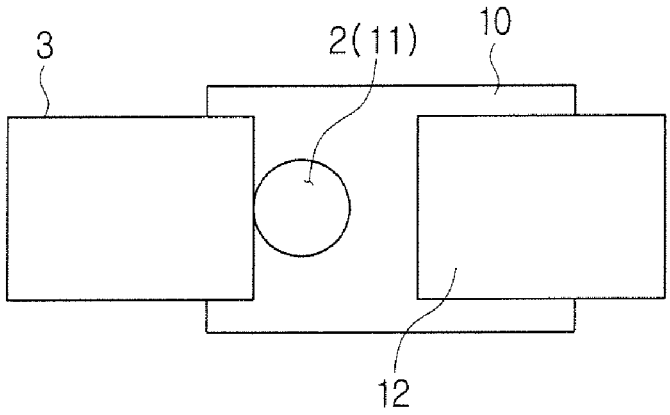
FIG. 3F (PRIOR ART)
Figure 4A:
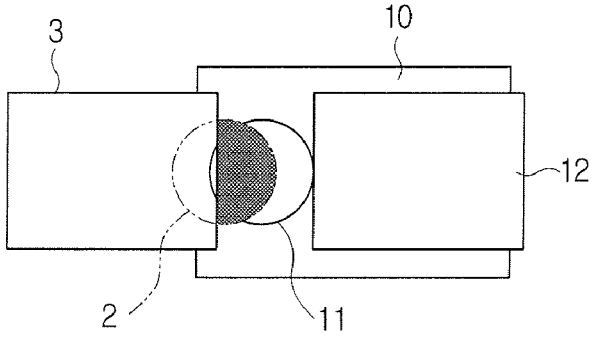
FIG. 4A (PRIOR ART)
FIGS. 4A through 4C are schematic views exemplifying toner leakage of the general toner path opening and closing apparatus of FIG. 1.
Figure 4B:
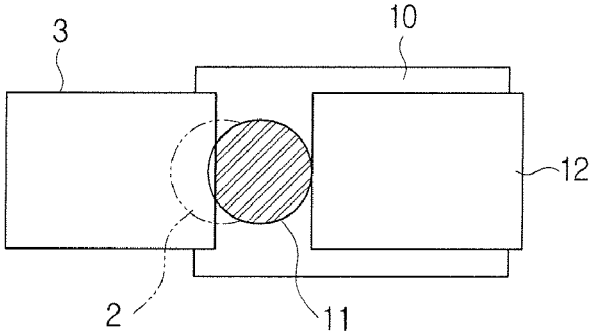
FIG. 4B (PRIOR ART)
Figure 4C:
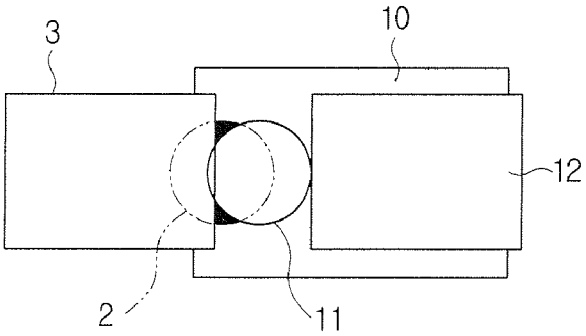
FIG. 4C (PRIOR ART)

Reference will now be made in detail to the present embodiments of the present invention, examples of which are illustrated in the accompanying drawings, wherein like reference numerals refer to like elements throughout. The embodiments are described below in order to explain the present invention by referring to the figures.

FIGS. 5A through 5H are schematic views exemplifying construction and operation of a toner path opening and closing apparatus of an image forming device according to an exemplary embodiment of the present invention. In FIGS. 5A through 5H, the toner path opening and closing apparatus includes a first shutter 103 to open and close a first toner path 102, and a second shutter 112 to open and close a second toner path 111, wherein after the second toner path 111 is completely opened, the first toner path 102 is opened, so that the first and second toner paths 102 and 111 communicate simultaneously with each other.

The first shutter 103 is elastically supported by a first elastic member 105 to open and close the first toner path 102, and the second shutter 112 is elastically supported by a second elastic member 115 to open and close the second toner path 111. In this embodiment, the first elastic member 105 is formed to have an elastic modulus K1 larger than the elastic modulus K2 of the second elastic member 115.

The first shutter 103 has a protrusion 103*a* and a hole 103*b* through the first shutter 103. The protrusion 103*a* comes in contact with a side end of a part in which the second toner path 111 is formed. The hole 103*b* is connected with the second toner path 111 upon opening of the second shutter 112.

A first sealing member 104 is interposed between the first toner path 102 and the first shutter 103, and a second sealing member 114 is interposed between the second toner path 111 and the second shutter 112. With these sealing members, toner leakage is prevented. The first and the second sealing members 104 and 114 may be formed of a sponge, urethane foam, or silicone rubber, and are preferably disposed adjacent to the first and the second shutters 103 and 112, so that the first and the second shutters 103 and 112 can be slidably moved. In this exemplary embodiment, the first toner path 102 is a toner supplying pipeline, which is disposed in the main body of the image forming device to receive toner from a toner cartridge (not illustrated), and the second toner path 111 is a toner injecting port, which is disposed in the developing unit 110 detachably disposed to the image forming device.

Figure 5A:
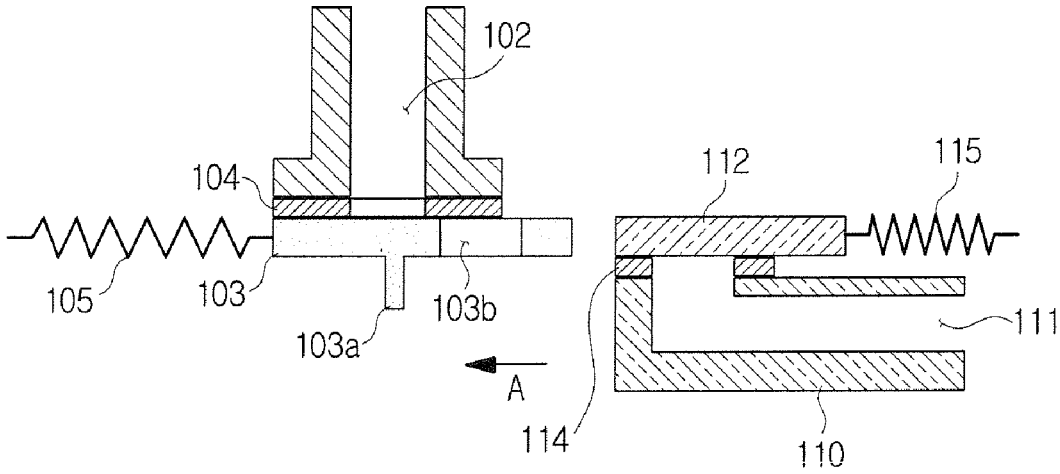
FIGS. 5A through 5H are schematic views exemplifying construction and operation of a toner path opening and closing apparatus of an image forming device according to an exemplary embodiment of the present invention.
Figure 5B:
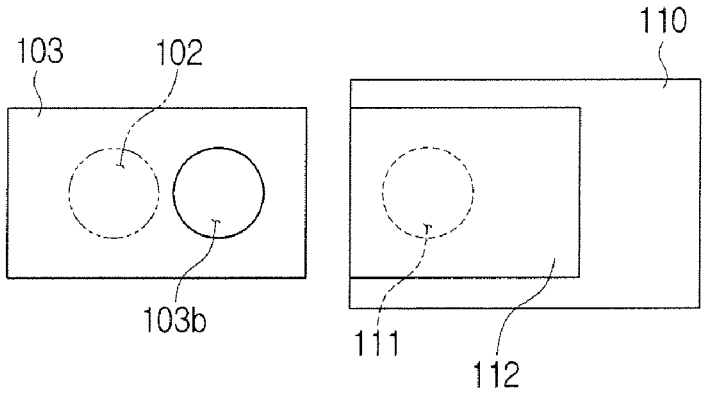

Hereinafter, operation of the toner path opening and closing apparatus of the image forming device and a toner path opening and closing method according to this exemplary embodiment of the present invention will now be described in detail with reference to the accompanying drawings. In FIGS. 5A and 5B, the first toner path 102, which is a toner supplying pipeline receiving the toner from the toner cartridge (not illustrated), is disposed in the main body of the image forming device. The first toner path 102 is opened and closed by the first shutter 103, which is slidably disposed adjacent to the toner path 102. The first shutter 103 is elastically supported by the first elastic member 105, which has the elastic modulus K1.

The second toner path 111, which is a toner injecting port communicating with the first toner path 102 to receive the toner, is disposed in the developing unit 110. Accordingly, when the developing unit 110 is mounted in a developing unit mount provided in the image forming device, the first and the second toner path 102 and 111 communicate with each other, so that the developing unit 110 can receive the toner from the first toner path 102.

In order for the first and the second toner paths 102 and 111 to communicate with each other, the first and the second shutters 103 and 112 closing the first and the second toner paths 102 and 111 should be moved in the direction of opening the first and the second toner paths 102 and 111, respectively. According to this exemplary embodiment, only after the second toner path 111 is completely opened, is the first toner path 102 opened.

Figure 5C:
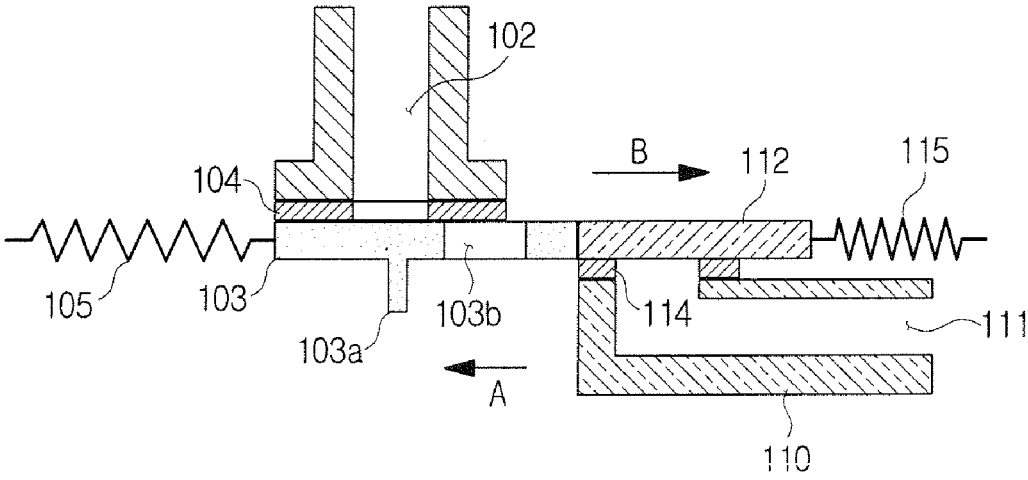
Figure 5D:
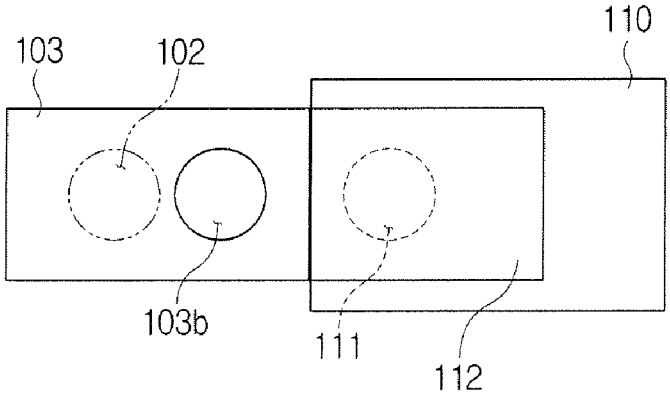

That is, as illustrated in FIGS. 5C and 5D, when the developing unit 110 is first inserted into the developing unit mount in the direction of arrow A, an end of the first shutter 103 comes in contact with the second shutter 112 and pushes the second shutter 112 in the direction of arrow B illustrated in FIG. 5C. At this first operation, since the first and the second shutters 103 and 112, respectively, move in against each other, when the second shutter 112 opens, the second toner path 111 is maintained in a closed state by the first shutter 103.

The hole 103*b* through the first shutter 103 has a diameter equivalent to the diameter of the second toner path. The second toner path 111 moves to a position facing the hole 103*b* through the first shutter 103 and the second toner path 111 opens as the second shutter 112 is moved in the direction of arrow B at the time the developing unit 110 is mounted into the developing unit mount. However, the second toner path 111 that faces the hole 103*b* is closed by the first shutter 103 and the second sealing member 114 supporting the first shutter 103, so that toner leakage is prevented.

On the other hand, since the second elastic member 115, which elastically supports the second shutter 112, has an elastic modulus K2 smaller than the elastic modulus K1 of the first elastic member 105, which elastically supports the first shutter 103, the second shutter 112 opens the second toner path 111 while sliding in the direction of arrow B, but the first shutter 103 does not move from a position of closing the first toner path 102; thus the first toner path 102 is maintained in a closed state. Accordingly, the first toner path 102, which is the toner supplying pipeline receiving the toner from the toner cartridge, is closed, but the second toner path 111, which is the toner injecting port disposed in the developing unit 110, is completely open.

Figure 5E:
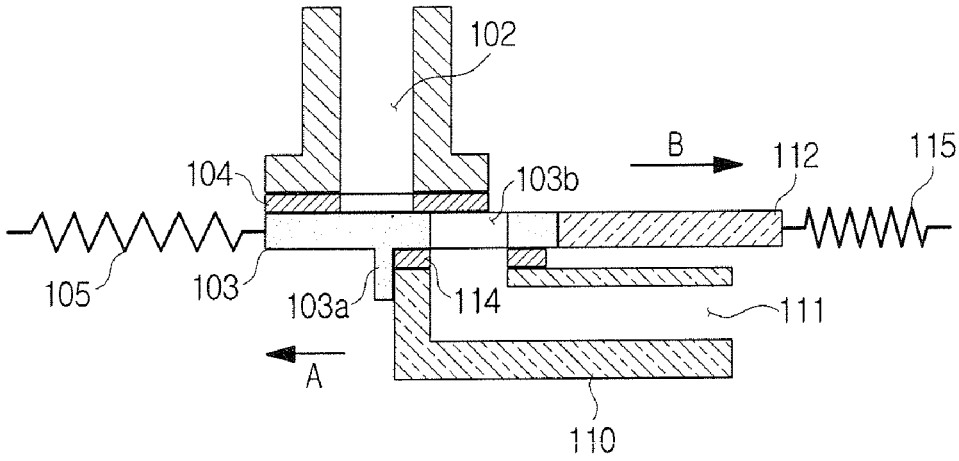
Figure 5F:
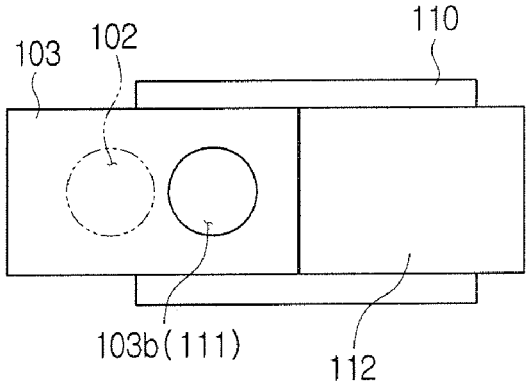
Figure 5G:
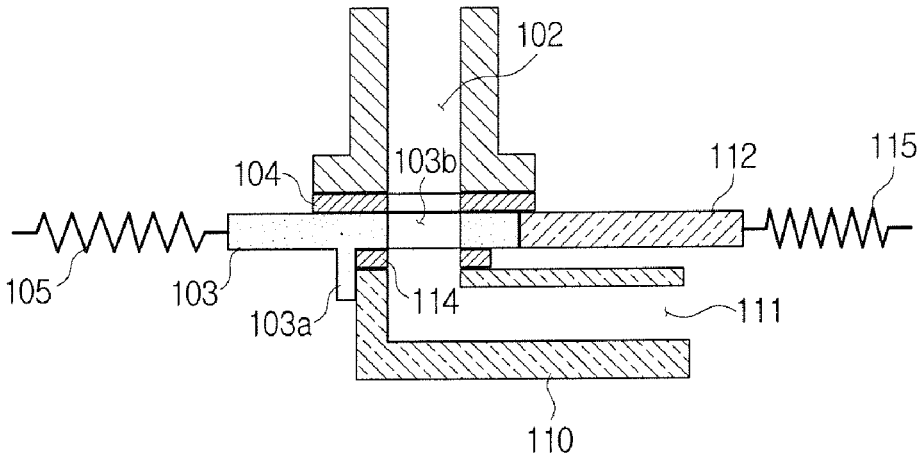
Figure 5H:
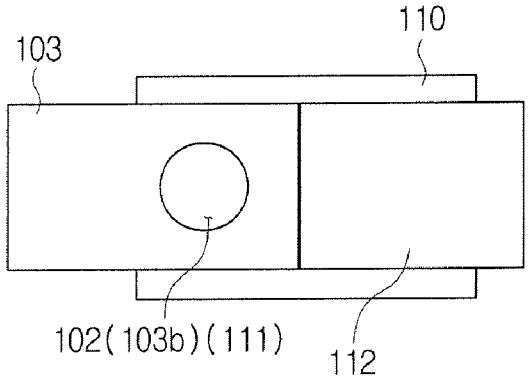

As described above, when the second toner path 111 is opened by the hole 103*b* through the first shutter 103, a side end of the developing unit 110 comes in contact with the protrusion 103*a* provided in the first shutter 103, as illustrated in FIGS. 5E and 5F. With the insertion of the developing unit 110, the protrusion 103*a*, which is integrally formed with the first shutter 103, transmits a force to the first shutter 103 and moves the first shutter 103 in the direction of arrow A. Accordingly, the first elastic member 105 elastically supports the first shutter 103 while contracting, and the first shutter 103 slides and moves until the first and the second toner paths 102 and 111 communicate with each other, as illustrated in FIGS. 5G and 5H.

If the developing unit 110 mounted in the main body of the image forming device is dismounted from the main body of the image forming device, the process is reversed. The first shutter 103 first closes the first toner path 102, then the second shutter 112 on the part of the developing unit 110 closes the second toner path 111.

That is, since the external force that is applied to the protrusion 103*a* projecting from the first shutter 103 is removed when the developing unit 110 is dismounted from the main body of the image forming device, the first shutter 103 is moved in the direction of closing the first toner path 102 by the reverse elastic force of the first elastic member 105. When the developing unit 110 is moved further in the dismounting direction after the first toner path 102 is closed by the first shutter 103, the first and the second shutters 103 and 112 are separated from each other, so that the second shutter 112 closes the second toner path 111 by the reverse elastic force of the second elastic member 115 only when the first toner path 102 and the second toner path 112 are no longer communicating with each other.

To summarize, in mounting of the developing unit 110, only after the second toner path 111, which is the toner injecting port, is first opened, is the first toner path 102, which is the toner supplying pipeline, opened, and in dismounting of the developing unit, only after the first toner path 102 is first closed, is the second toner path 111 closed, so that in mounting and dismounting of the developing unit the toner is prevented from leaking through connecting parts. Although to facilitate the understanding of this embodiment, the connection of the toner supplying pipeline 102 and the toner injecting port 111 of the developing unit 110 are illustrated, the present invention is not limited thereto. The functioning of the first and the second toner path 102 and 111 are applicable to other parts in the image forming device that require a selective or serial connection of the path.

FIGS. 6A through 6E are schematic views exemplifying a toner path opening and closing apparatus of an image forming device according to another exemplary embodiment of the present invention in which a second elastic member 115 is disposed to a second shutter 112 installed on the part of the developing unit 110 while interposing a rotating lever 300 therebetween. The rotating lever 300 is rotatably disposed on a side surface of the second shutter 112, and is urged in the direction of arrow C illustrated in FIG. 6A by a torsion spring (not illustrated). The second elastic member 115 is connected to an end of the rotating lever 300, so that the second shutter 112 is elastically supported by the second elastic member 115 via the rotating lever 300.

The rotating lever 300 includes a moving part 310, and first and second protrusions 320 and 330. The moving part 310 rotates the rotating lever 300 by coming in contact with an interference member 400 fixed to and projected from the developing unit 100 in the open operation of the second shutter 112. The first and the second protrusions 320 and 330 are projected from an opposite end of the rotating lever 300 to the moving part 310 to selectively restrain the position of the second shutter 112 according to the position of insertion of the developing unit 100.

The interference member 400 may be formed of a switching member, which can be popped into and out of the developing unit 100 when the user switches the old and new developing units 110. The user can pop interference member 400 in and out to change the positions of the first and the second protrusions 320 and 330 as the occasion demands.

Figure 6A:
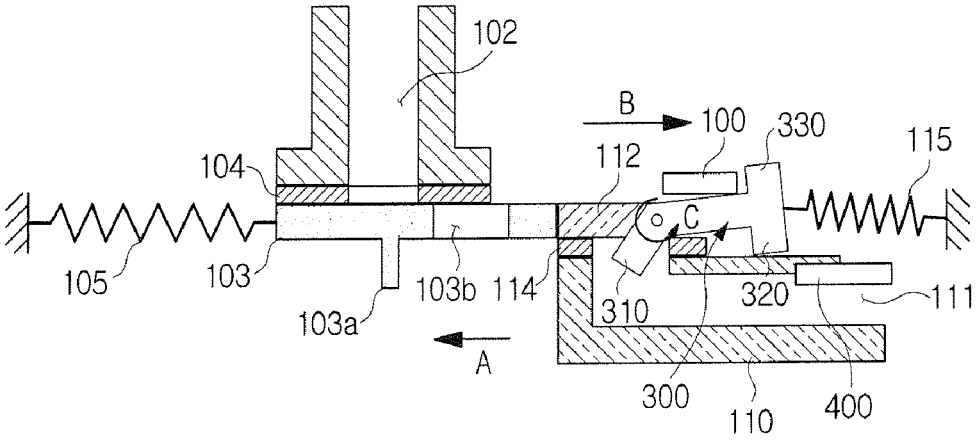
FIGS. 6A through 6E are schematic views exemplifying construction and operation of a toner path opening and closing apparatus of an image forming device according to another exemplary embodiment of the present invention.
Figure 6B:
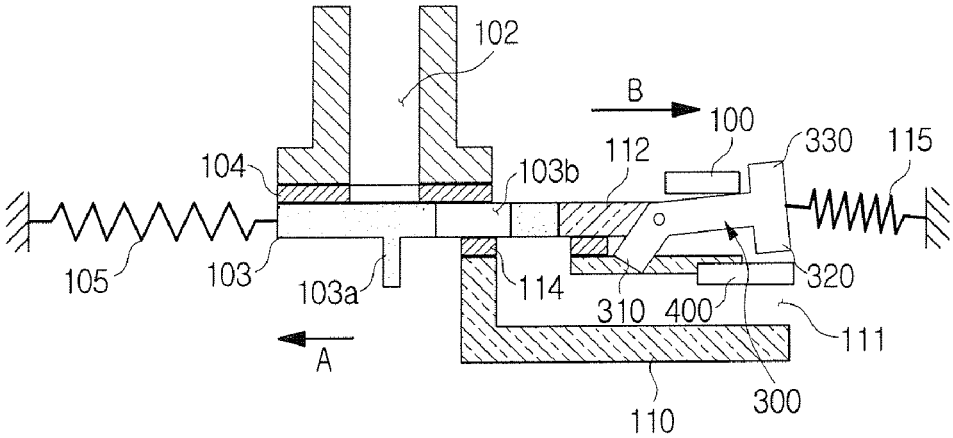
Figure 6C:
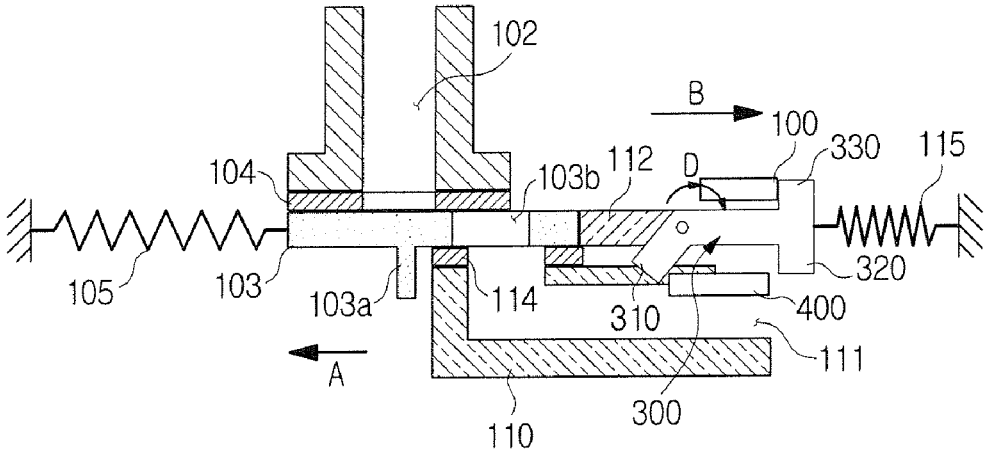

For example, when the developing unit 110 is inserted, the second shutter 112 is slid and moved by the first shutter 103, and as the second shutter 112 is opened, the interference member 400 fixed to the developing unit 100 rotates the rotating lever 300 in the direction of arrow D illustrated in FIG. 6C while coming in contact with the moving part 310 of the rotating lever 300.

Figure 6D:
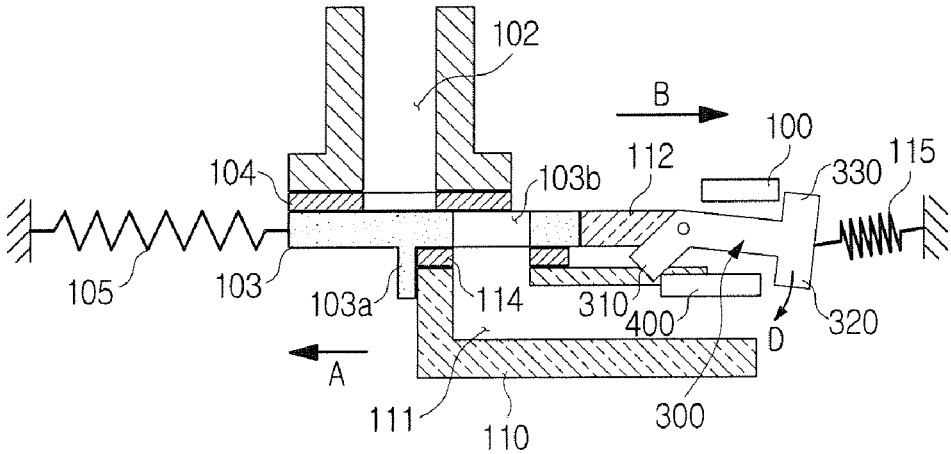

When the developing unit is inserted further as described above, the second protrusion 330, which hits inlet 100 of the developing unit-seating part of the image forming device as illustrated in FIGS. 6A and 6B, releases the interference member to the inlet 100 as illustrated in FIGS. 6C and 6D. The first protrusion 320 therefore hits the interference member 400 to prevent the second shutter 112 from sliding in the direction of closing the second toner path 111.

Figure 6E:
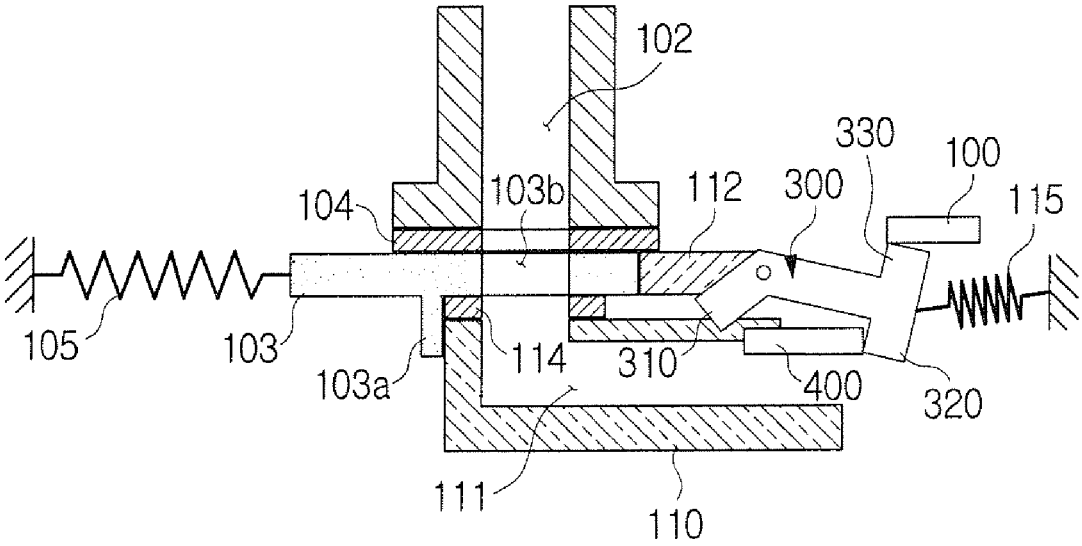

After that, as illustrated in FIG. 6E, when the developing unit is completely inserted in the mounting position, as positions of the first and the second shutters 103 and 112 balance with each other, the first protrusion 320 remains connected to the interference member 400. Furthermore, since the second protrusion 330 is supported by an inner surface of the inlet 100, the second shutter 112 can remain fixed in an opened state when the developing unit 110 is in place in the image forming device.

As described above, if the second elastic member 115 is installed via the rotating lever 300, the linear distance of the second elastic member 115 is reduced. As a result, the space that is necessary for obtaining the reverse elastic force of the second elastic member 115 can be reduced, thereby allowing the image forming device to be reduced in size.

As is apparent from the foregoing description, according to the exemplary embodiments of the present invention, the toner path opening and closing apparatus, the image forming device having the same apparatus and the toner path opening and closing method thereof are configured so that in dismounting of the developing unit, after the second shutter disposed in the developing unit is first opened to open the toner injecting port, the first shutter is opened to open the toner supplying pipeline, and in dismounting of the developing unit, after the toner supplying pipeline is first closed, the toner injecting port is closed, thereby preventing the toner from being leaked through connecting parts in mounting and dismounting of the developing unit.

Furthermore, in conventional construction, an additional structure can be disposed in the main body of the image forming device to realize the toner path opening closing operation as described above. In this case, the moving distance of the second shutter installed on the part of the developing unit is lengthened, thereby resulting in restrictions on space and restrictions on the choice of material for the second elastic member on the developing unit.

However, according to one aspect of the present invention, the elastic moduli of the first and second elastic members are set differently from each other. Accordingly, without installing the additional structure, the order of opening and closing the first and the second shutters can be set within a short moving distance of the shutters by using a difference of applying force between the elastic members.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming device, comprising:

a toner cartridge detachably disposed to the main body of an image forming device and connected to a first toner path for supplying a toner;

a developing unit in which a second toner path is formed to connect with the first toner path;

a first shutter elastically supported by a first elastic member to open and close the first toner path; and a second shutter elastically supported by a second elastic member having an elastic modulus smaller than the first elastic member to open and close the second toner path by the first shutter, wherein after the second toner path is opened by the first shutter, the first toner path is opened, so that the first and the second toner paths communicate with each other.

2. The device of claim 1, wherein the first shutter comprises a hole through the first shutter to communicate with the second toner path.

3. The device of claim 2, wherein the first shutter comprises a protrusion to come in contact with a member in which the second toner path is formed.

4. The device of claim 1, further comprising:

a first sealing member interposed between the first toner path and the first shutter; and a second sealing member interposed between the second toner path and the second shutter.

5. The device of claim 4, wherein the first and the second sealing members are selected from the group consisting of sponge, urethane foam, and silicone rubber.

6. The device of claim 1, wherein the first toner path comprises a toner supplying pipeline disposed in the main body of the image forming device to receive toner from the toner cartridge, and the second toner path comprises a toner injecting port disposed in the developing unit detachably joined to the main body of the image forming device.

7. The device of claim 1, wherein a rotating lever has one end connected to the second elastic member and one end connected to the second shutter, to rotate in combination with the sliding movement of the second shutter.

8. The device of claim 7, wherein the rotating lever comprises:

a moving part to receive a rotating force by an interference member in open operation of the second shutter; and first and second hanging protrusions projecting to selectively restrain the position of the second shutter.

9. A toner path opening and closing apparatus of an image forming device, comprising:

a first shutter elastically supported by a first elastic member to open and close a first toner path; and a second shutter elastically supported by a second elastic member having an elastic modulus smaller than the first elastic member to open and close a second toner path by the first shutter, wherein after the second toner path is opened by the first shutter, the first toner path is opened, so that the first and the second toner paths then communicate with each other.

10. The apparatus of claim 9, wherein the first shutter comprises a hole through the first shutter to communicate with the second toner path.

11. The apparatus of claim 9, wherein the first toner path comprises a toner supplying pipeline disposed in the main body of the image forming device to receive a toner from a toner cartridge, and wherein the second toner path comprises a toner injecting port disposed in a developing unit detachably joined to the main body.

12. The apparatus of claim 9, further comprising a rotating lever, wherein the rotating lever has one end connected to the second elastic member and one end connected to the second shutter, to rotate in combination with a sliding movement of the second shutter.

13. The apparatus of claim 12, wherein the rotating lever comprises:

a moving part to receive a rotating force by an interference member in open operation of the second shutter; and first and second protrusions projecting to selectively restrain the position of the second shutter.

14. Atoner path opening and closing method for an image forming device, comprising:

opening a second toner path by pushing out a second shutter for opening and closing a second toner path by a first shutter for opening and closing a first toner path; and opening the first toner path by the first shutter after the second toner path is completely opened to communicate the first and the second toner paths with each other.

15. The method of claim 14, further comprising opening the second toner path via a hole through the first shutter.

16. The method of claim 14, wherein the first toner path further comprises a toner supplying pipeline disposed in a main body of the image forming device to receive a toner from a toner cartridge, and the second toner path further comprises a toner injecting port disposed in a developing unit detachably joined to the main body of the image forming device.

17. The device of claim 6, further comprising an interference member fixed to and projecting from the developing unit.

18. The device of claim 17, wherein the interference member is switchable into place when one developing unit is removed and another is installed.

19. A toner path opening method for an image forming device, comprising:

placing a developing unit for the image forming device into the image forming device;

first opening a toner injecting port in the developing unit by pushing out a second shutter for opening and closing the toner injecting port by a first shutter for opening and closing a toner supplying pipeline; and then opening the toner supplying pipeline by the first shutter after the toner injecting port is completely opened to communicate the toner supplying pipeline and the toner injecting port with each other, wherein a hole through the first shutter allows the flow of toner between the toner supplying pipeline and the toner injecting port.

20. A toner path closing method for an image forming device, comprising:

removing a developing unit for the image forming device from the image forming device;

first closing a toner supplying pipeline by a first shutter in order to end communication between the toner supplying pipeline and a toner injecting port in the developing unit without leakage of toner; and then closing the toner injecting port in the developing unit by closing a second shutter after release of pressure on the second shutter via movement of the first shutter.

* * * * *